United States Patent [19]

Amabili

[11] 4,060,172

[45] Nov. 29, 1977

[54] CONTAINER AND CLOSURE CAP

[76] Inventor: Arnaldo Amabili, 7680 Dollier, St. Leonard, Quebec, Canada

[21] Appl. No.: 735,783

[22] Filed: Oct. 26, 1976

Related U.S. Application Data

[63] Continuation-in-part of Ser. No. 670,060, March 24, 1976, abandoned.

[51] Int. Cl.[2] ..... B65D 41/12

[52] U.S. Cl. ..... 215/295; 215/328; 215/343

[58] Field of Search ..... 215/253, 295, 301, 302, 215/304, 324, 328

[56] References Cited

U.S. PATENT DOCUMENTS

| | | | |
|---|---|---|---|
| 1,153,706 | 9/1915 | Rosencrantz | 215/301 |
| 1,605,708 | 11/1926 | Clark | 215/301 |
| 2,156,258 | 5/1939 | Atwood | 215/253 X |
| 2,443,181 | 6/1948 | Beeson | 215/302 |
| 2,607,505 | 8/1952 | Hennon | 215/253 |
| 3,382,997 | 5/1968 | Tsuji | 215/253 |

FOREIGN PATENT DOCUMENTS

| | | | |
|---|---|---|---|
| 80,579 | 4/1963 | France | 215/253 |

*Primary Examiner*—Donald F. Norton

*Attorney, Agent, or Firm*—McFadden, Fincham & Co.

[57] ABSTRACT

The present invention provides a pilfer-proof resealable crown closure cap which has a top crown and a skirt depending from the top crown, the skirt having a pair of diametrically opposed slots therein, each slot extending substantially the full height of the skirt. Preferably, each of the slots has a generally inverted U-shaped configuration and the skirt is provided with rounded corners at the free marginal edges of the skirt and slots.

10 Claims, 15 Drawing Figures

FIG. 1
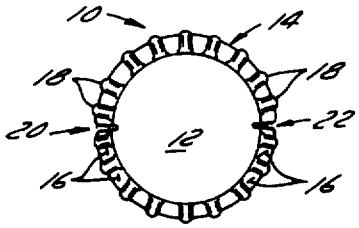
FIG. 2
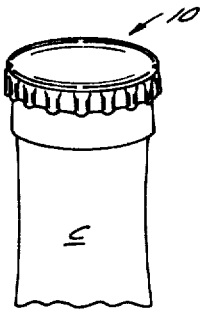
FIG. 3
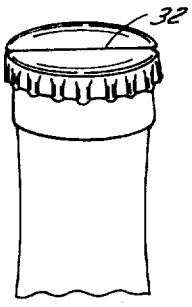
FIG. 4
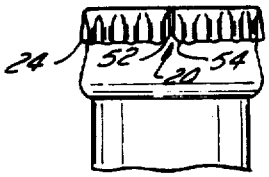
FIG. 5
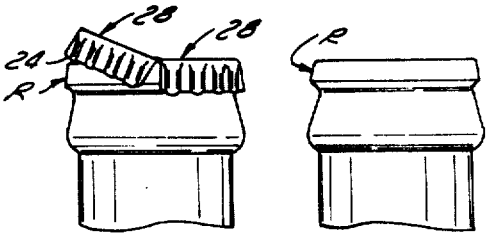
FIG. 6
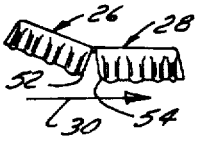
FIG. 7
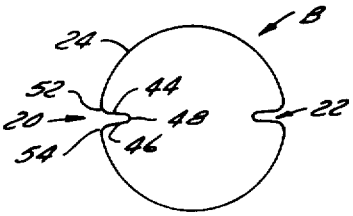
FIG. 8
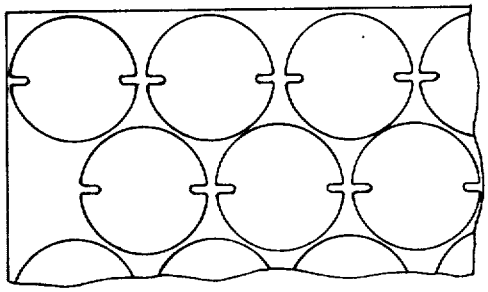
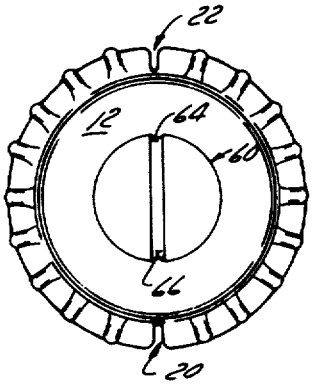
FIG. 9
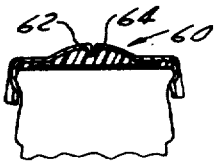
FIG. 10
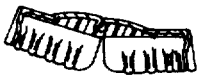
FIG. 11

FIG. 12
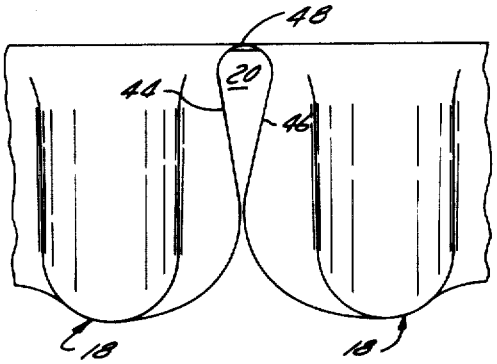
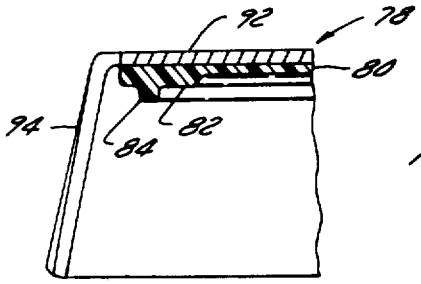
FIG. 14
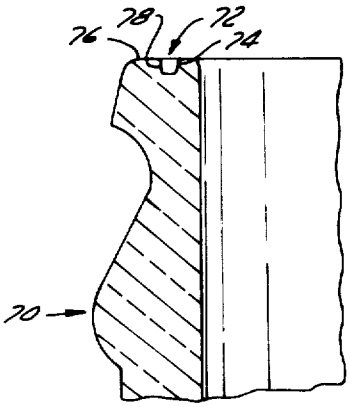
FIG. 13
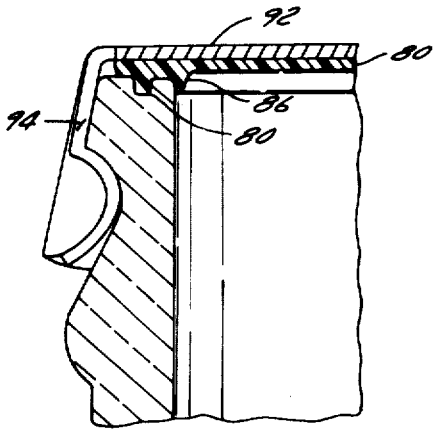
FIG. 15

CONTAINER AND CLOSURE CAP

This application is a continuation-in-part of U.S. Patent application Ser. No. 670,060, filed Mar. 24, 1976, now abandoned.

The present invention relates to closure caps and more particularly relates to a pilfer-proof resealable crown closure cap.

Crown closure caps have been employed in the bottling industry and are in general use particularly for bottles containing carbonated beverages such as pop and alcoholic beverages — i.e., beer. Generally, such crown closure caps comprise a top crown and a depending skirt, the skirt being crimped or corrugated with a plurality of alternating ribs and valleys or indentations therein. The crown top of the closure cap generally has a liner material on the underside thereof — materials such as cork and more recently, elastomeric materials have been used. The closure cap is usually preformed and then crimped on the bottle to effect a tight seal. Such caps can be removed by use of conventional opening tools or devices which engage a free marginal edge of the skirt and employing a levering action, one side of the cap is deformed and removed from the container.

As aforementioned, these crown caps have enjoyed a great deal of commercial success. However, an inherent problem is that the container cannot be resealed using the same closure cap since the cap has been deformed in opening. Thus, such crown closure caps are not particularly suitable for use with larger containers of carbonated beverages wherein all of the contents generally are not used at the same time.

To obviate the above problem, two solutions have been proposed. Initially, crown caps have been provided with screw threads mating with threads on the container neck. However, crown closure caps with threads have not received a wide commercial acceptance — the resealing function is not always effective. A further closure cap known in the art which overcomes some of the aforementioned problems is a screw-on type cap formed of a ductile metallic material such as an aluminum alloy. These caps are clamped on the bottle and threads formed in the skirt portion. Although these caps do provide a resealing function, problems have arisen in production of the caps and many manufacturers prefer a crown cap structure as presenting a minimum of production problems.

A further problem associated with the threaded crown caps is that they are not pilfer-proof. Thus, since the container can be resealed with the same closure cap, tampering with the contents could occur and one has no means of knowing whether or not any particular container has been tampered with.

Therefore, it is an object of the present invention to provide a crown closure cap which is resealable.

It is a further object of the present invention to provide a resealable crown closure cap having pilfer-proof means associated therewith to indicate when the closure cap has been removed from the container.

It is a still further object of the present invention to provide a pilfer-proof resealable crown closure cap which may be adapted to presently existing bottles and containers and is safe to use, all sharp edges being minimized.

Generally, according to one aspect of the present invention, there is provided a pilfer-proof resealable crown closure cap comprising a top crown and a skirt depending from said top crown, said skirt having a pair of diametrically opposed slots therein, the slots extending substantially the full height of the skirt. Each of the slots has a generally inverted U-shaped configuration and rounded corners are present at the free marginal edges of the skirt and slots.

In a further aspect of the present invention, there is provided a pilfer-proof resealable crown closure cap having a top crown and a skirt depending therefrom with a pair of diametrically opposed slots in the skirt portion. The crown top includes bend limiting means to limit the amount the top can be bent when the closure cap is removed from the container. Preferably, the bend limiting means may comprise a slightly raised dome in the centre of the crown with a groove in the dome aligned with an imaginary line extending between the slots.

In greater detail, the crown closure cap, in the preferred embodiment, comprises a disc-shaped crown top and an annular peripheral skirt depending therefrom and terminating in a free marginal edge. The skirt has a pair of diametrically opposed slots therein, each slot being defined by an upper wall and a pair of opposed side walls. Each slot extends from the free end margin of the skirt upwardly substantially the full height of the skirt. The top wall is arcuate in configuration and merges with the side walls. In turn, the side walls merge arcuately with the free end margin to form rounded corners thereat.

The closure cap according to the present invention is formed of a metallic material and a tinplate material may be employed. In this respect, black plate may be produced by hot rolling, pickling, cold rolling, cleaning, continuously annealing, then temper rolling and cleaning the plate; the plate may then be coated with tin by an electrolytic treatment. The cap may conveniently have a thickness ranging between 0.0099 inch and 0.0105 inch.

The crown closure cap according to the present invention has a substantially conventional disc-shaped crown top with a skirt depending therefrom. The skirt is "crimped" to provide a plurality of ribs and valleys or indentations therein.

The slots formed in the skirt of the closure cap according to the present invention are critical to the operation of the cap and the resealing function thereof. In this respect, it will be understood that the term "slots" indicates that material has been removed from the skirt — this is the opposite of "slits" which denote merely a cutting of the skirt. It has been found that employing slits in a closure cap according to the present invention is not suitable since a proper resealing function is not obtained. A pair of slots are provided in the skirt and may be formed in either the ribs or the valleys thereof although it is preferred that they be cut within a valley. The slots are diametrically opposed, each slot being defined by an upper wall and a pair of opposed side walls; when the closure cap is on the container, the slots have a substantially inverted U-shaped configuration.

The slots are formed in the skirt such that at the lower end thereof where the side walls defining the slot merge with the lower marginal edge of the skirt, there are provided rounded corners. These rounded corners eliminate a hazard to the user when resealing the container.

Having thus generally described the invention, reference will be made to the accompanying drawings illustrating embodiments thereof, in which:

FIG. 1 is a top plan view of a closure cap after being cut and preformed, but prior to placement on a container;

FIG. 2 is a perspective view of a closure cap according to the present invention after being placed on a container;

FIG. 3 is a view similar to FIG. 2 illustrating the closure cap after opening and resealing the container;

FIGS. 4, 5 and 6 illustrate the removal of a closure cap from a container;

FIG. 7 is a top plan view of a blank for forming the closure cap of the present invention;

FIG. 8 illustrates the cutting of blanks to form closure caps;

FIG. 9 is a top plan view of a further embodiment of a closure cap according to the present invention;

FIG. 10 is a cross-sectional view of the cap of FIG. 9 when placed on a container;

FIG. 11 is a side elevational view, partially in section, of the closure cap of FIGS. 9 and 10 illustrating the bend limiting means;

FIG. 12 is an exploded side elevational view of a slot in a closure cap;

FIG. 13 is a side sectional view of a portion of a container formed according to one aspect of the present invention;

FIG. 14 is a side sectional view of a further embodiment of a closure cap suitable for use with the container of FIG. 13; and FIG. 15 is a side sectional view of a closure cap placed on a container neck.

Referring initially to FIG. 1, there is illustrated therein a closure cap 10 as cut and preformed, but prior to final crimping on the container.

Cap 10 comprises a crown top 12 and a skirt generally designated by reference numeral 14. Skirt 14 is crimped to form a plurality of ribs 18 and corresponding valleys or indentations 16. A pair of slots 20 and 22 are formed in skirt 14 at diametrically opposed points.

As shown in FIG. 4, closure cap 10 is applied to a container C in a conventional manner. Thus, the preformed cap is placed on the neck of the container with the indentations or valleys 16 being deformed and pushed in under the rim R of the container.

To open the container, a conventional opening tool or device may be used — i.e., a levering action is employed whereby a free marginal edge 24 is engaged by a portion of the device and a further portion engages crown top 12. By so doing, a bending and pivoting action occurs such that a half section 26 bends and pivots on a line between slots 20 and 22 as illustrated in FIG. 5. The remaining half section 28 remains in position and then may be slid off the container in the direction of arrow 30 as indicated in FIG. 6.

For resealing the container, the bent cap is moved laterally back on the bottle with half section 28 being placed in the position shown in FIG. 5. Half section 26 may then be moved down and snapped over rim R to close and reseal the container.

As shown in FIG. 3, the opening and resealing of the container leaves a visible crease or bend line 32 extending between slots 20 and 22 thus showing that the bottle has been opened at least once. This feature indicates to the purchaser whether the container has been tampered with or not.

Turning to FIG. 7, a typical blank B from which a closure cap according to the present invention may be manufactured is illustrated. Blank B is a disc-shaped piece of material in which a pair of diametrically opposed slots 20 and 22 have been cut. Slot 42 is defined by a pair of opposed side walls 44 and 46 and a "top" wall 48. In forming the slots, top wall 48 merges smoothly with walls 44 and 46 and in the illustrated embodiment, is arcuate throughout. Side walls 44 and 46 diverge as they progress towards the outer edge 24 of the disc and merge smoothly and arcuately to provide rounded corners 52 and 54 respectively.

As shown in FIG. 8, a plurality of blanks may be cut from a suitable piece of material with a minimum wastage of material. Normally, in cutting blanks as illustrated in FIG. 8, an initial crimping operation is carried out to provide a closure cap such as illustrated in FIG. 1.

FIG. 12 is a detailed view of the slots in the skirt following resealing of the container. Slot 20 is preferably formed so as to be between a pair of ribs 18. Upon a resealing of a container, slot 42 assumes the configuration shown in FIG. 12. Thus, side walls 44 and 46 taper inwardly towards each other as they digress to the free marginal edge of skirt 14. Proximate crown top 12, there is a substantial gap between the side walls while near the bottommost portion, the side walls come close to touching each other.

Generally, the configuration of the slot is due to a pressure on the underside of crown top 12 by the pressurized gases in the container. This pressure causes the lower portion of side walls 44 and 46 to bend inwardly towards each other which in turn, results in a more effective resealing.

It may be desirable to limit the amount that the closure cap is bent when removing it so that it can be readily reused. As shown in FIGS. 9 to 11, the cap may be provided with a slightly raised or domed portion 60 in the centre of crown top 12. A groove generally designated by numeral 61 and defined by side walls 62 and 64 and a bottom wall 66 is provided in slightly raised or domed portion 60. The groove is generally aligned with a line between slots 20 and 22. In operation, when the cap is bent along the line between slots 20 and 22, which line includes groove 61, wall 62 on the bent half of the cap abuts wall 64 on the other half of the amount the closure cap is bent. Thus, this prevents the cap from being bent too far and possibly split.

In the above embodiments, slots 20 and 22 extend substantially the full height of the skirt 14. In most cases, it is preferable that the slots have a height of at least 90 percent of the skirt height and the slots can, on occasion, extend slightly into the crown top portion 12.

In a typical crown cap, the slots, when formed, may have a width ranging between ⅛ inch and 1/16 inch; this can be varied depending on the size of the cap according to the teachings of the present invention. The top wall 48 of the slots is preferably, as aforementioned, arcuate in configuration. By so doing, when the cap is removed from the bottle, the stress is concentrated at the apex of the arcuate portion thus permitting easier removal of the cap. Of course, top wall 48 need not be arcuate throughout; it is only necessary that it merge smoothly with side walls 44 and 46.

According to a further aspect of the present invention, a container 70 is provided with a groove 72 in the upper surface of rim 76. Groove 72 is partially defined by side walls 73 and 74 which are parallel to each other to form a substantially rectangularly shaped groove.

As seen in FIG. 14, closure cap 78, which comprises a crown top 92 and skirt 94, may have a liner generally designated by reference numeral 80 secured to the underside thereof. Liner 80 has, at its peripheral edge, a thickened portion generally designated by reference numeral 82 and a tongue 84 extending from thickened portion 82. Tongue 84 is adapted to seat in groove 72 to provide a better resealing effect.

A modification of the above arrangement is shown in FIG. 15 wherein liner 80 has the tongue 84 as described above and further includes portion 86 which is sealed against the inner rim portion of the container neck.

It will be understood that the above-described embodiments are preferred ones only and that changes and modifications may be made thereto without departing from the spirit and scope of the invention.

I claim:

1. In combination, a container comprising a body portion enclosing a cavity adapted to retain a commodity therein, a dispensing aperture communicating with said cavity, and a cylindrical neck having a rim surrounding said aperture; and, a closure cap, said closure cap comprising a top crown covering said aperture and seating on said rim, and a skirt depending from said top crown in a sealing relationship with said neck, said skirt having a pair of diametrically opposed slots therein, said slots being defined by a pair of side walls and a top wall, each of said slots extending from a free marginal edge of said skirt to said top crown, said side walls merging arcuately with the free marginal edge of said skirt and with the top wall, said side walls being spaced apart proximate the top wall and tapering inwardly in the direction of the free marginal edge.

2. The combination of claim 1 wherein said closure cap includes a liner on the side of the top crown seating on said rim.

3. The combination of claim 2 wherein said rim of said container has an annular groove therein.

4. The combination of claim 3 wherein said liner includes a tongue adapted to seat in said groove in said rim.

5. The combination of claim 1 wherein said closure cap includes bend limiting means therein comprising a slightly raised dome in the centre of said top crown, the area of said dome being a minor portion of the total area of the top crown, and a groove in said dome aligned with said pair of slots, said groove being defined by a pair of parallel side walls and a bottom wall, such that when said closure cap is removed from said container, said side walls abut to limit the amount said closure cap may be bent.

6. The combination of claim 5 wherein said closure cap is formed of a steel alloy.

7. The closure cap of claim 1 wherein said top wall of said slot is arcuate throughout.

8. The combination of claim 2 wherein said skirt is corrugated having a plurality of alternating ribs and valleys.

9. The combination of claim 8 wherein said slots are formed in said valleys.

10. The combination of claim 9 wherein the neck of said container has a circumferentially extending groove, the skirt of said closure cap engaging with said groove.

* * * * *